US010724185B2

(12) United States Patent
Singh

(10) Patent No.: US 10,724,185 B2
(45) Date of Patent: Jul. 28, 2020

(54) METHOD AND APPARATUS TO ENHANCE CONNECTION STRENGTH BETWEEN ADJACENT ARTIFICIAL TURF MEMBERS

(71) Applicant: Rajeev Kumar Singh, Chandler, AZ (US)

(72) Inventor: Rajeev Kumar Singh, Chandler, AZ (US)

( * ) Notice: Subject to any disclaimer, the term of this patent is extended or adjusted under 35 U.S.C. 154(b) by 193 days.

(21) Appl. No.: 16/042,081

(22) Filed: Jul. 23, 2018

(65) Prior Publication Data

US 2020/0024810 A1 Jan. 23, 2020

(51) Int. Cl.
*A41G 1/00* (2006.01)
*E01C 13/08* (2006.01)

(52) U.S. Cl.
CPC ..... *E01C 13/08* (2013.01)

(58) Field of Classification Search
CPC ..... E01C 13/08; E01C 13/083; A01G 20/00; A01G 20/10; A01G 20/20; A41G 1/009
See application file for complete search history.

(56) References Cited

U.S. PATENT DOCUMENTS 2,069,310 A * 2/1937 Higgins ..... A47G 27/0437 428/62
3,413,678 A * 12/1968 Krantz ..... A47G 27/0462 16/16
3,817,015 A * 6/1974 Frangos ..... A47G 27/0406 52/511
3,862,874 A * 1/1975 Hopper ..... E04F 15/10 428/47
5,198,300 A * 3/1993 Matthews ..... A47G 27/0443 428/354
5,693,171 A * 12/1997 Foster ..... A47G 27/0443 156/163
6,395,362 B1 * 5/2002 Pacione ..... A47G 27/0293 428/45
7,249,913 B2 * 7/2007 Linville ..... A63C 19/02 404/73
7,838,096 B2 * 11/2010 Hayes, II ..... B29C 65/562 428/62
8,029,376 B2 * 10/2011 Shaneour ..... E01C 13/08 405/49
8,329,265 B2 * 12/2012 Cook ..... E01C 13/08 428/17

* cited by examiner

*Primary Examiner* — Kristen C Hayes
(74) *Attorney, Agent, or Firm* — Plager Schack LLP

(57) ABSTRACT

A method to secure an adjacent pair of turf members to a ground surface is provided. The method includes disposing a joint strip on the ground surface, disposing a first turf member on the joint strip, inserting a first set of primary fasteners through the first turf member, joint strip and ground surface, inserting a first set of secondary fasteners through the first turf member, joint strip and ground surface, disposing a second turf member on the joint strip to permit a side edge of the second turf member to align with the side edge of the first turf member along a seam line, inserting a second set of primary fasteners through the second turf member, joint strip and ground surface, and inserting a second set of secondary fasteners through the second turf member, joint strip and ground surface.

10 Claims, 4 Drawing Sheets

METHOD AND APPARATUS TO ENHANCE CONNECTION STRENGTH BETWEEN ADJACENT ARTIFICIAL TURF MEMBERS

BACKGROUND

The embodiments herein relate generally to artificial turf.

Artificial turf is a surface made from synthetic fibers that are designed to look like natural grass. Currently, artificial turf pieces are commonly joined using two gluing techniques. In the first technique, glue and strips of plastic fiber tape 3 to 12 inches in width are used to keep the two pieces of turf joined together. In this process, fiber tape is used as a backing where the glue is spread thereon and both pieces of turf are placed on the center of the tape to attach the three pieces together. In the second technique, high temperature heat-activated gluing tape 3 to 6 inches wide is used. A hot electric iron is used to activate the gluing property of the tape to secure the artificial turf members disposed on the tape together.

However, these glue techniques involving the plastic fiber tape and heat-activated backing tape require great skill by the installer and are problematic. In particular, the proximity of the artificial turf members changes as the glue dries. This is because the glue is very sensitive to any movement in the turf members before the glue cures. As a result, the turf members do not retain the same position where originally placed. These techniques are also problematic because years of expansion and contraction of the glue seam exposes the seam line. This is not aesthetically pleasing.

An alternative technique to secure artificial turf members together involves the use of U shape nails. Adjacent artificial turf members are aligned together and disposed on the ground. The artificial turf members are nailed together into the ground across seam-line using the U shape nails. However, this technique lacks strength and durability. Thermal stresses due to changes in temperature/seasons and pedestrian traffic on the turf members cause the seam of the turf members to be exposed easily.

As such, there is a need in the industry for a method and apparatus to enhance the strength of connection between adjacent artificial turf members. There is a further need in the industry for a method and apparatus to minimize exposure of the seam between adjacent artificial turf members.

SUMMARY

A method to secure an adjacent pair of turf members to a ground surface with enhanced connection strength and reduce visibility of a seam line along corresponding edges of the secured adjacent turf members is provided. Each turf member in the pair of turf members comprises a side edge extending along the seam line and a plurality of blades of grass coupled to the turf member along a set of parallel stitch rows. The method comprises disposing a joint strip on the ground surface, disposing a first turf member on a first portion of the joint strip, inserting a first set of primary fasteners through the first turf member on the side edge along the seam line, joint strip, and the ground surface, inserting a first set of secondary fasteners through the first turf member, joint strip and the ground surface in spacing between the stitch rows of the first turf member, disposing a second turf member on a second portion of the joint strip to permit the side edge of the second turf member to align with the side edge of the first turf member along the seam line, inserting a second set of primary fasteners through the second turf member on the side edge along the seam line, joint strip, and the ground surface, and inserting a second set of secondary fasteners through the second turf member, joint strip and the ground surface in spacing between stitch rows of the second turf member.

BRIEF DESCRIPTION OF THE FIGURES

The detailed description of some embodiments of the invention will be made below with reference to the accompanying figures, wherein the figures disclose one or more embodiments of the present invention.

DETAILED DESCRIPTION OF CERTAIN EMBODIMENTS

Figure 1:
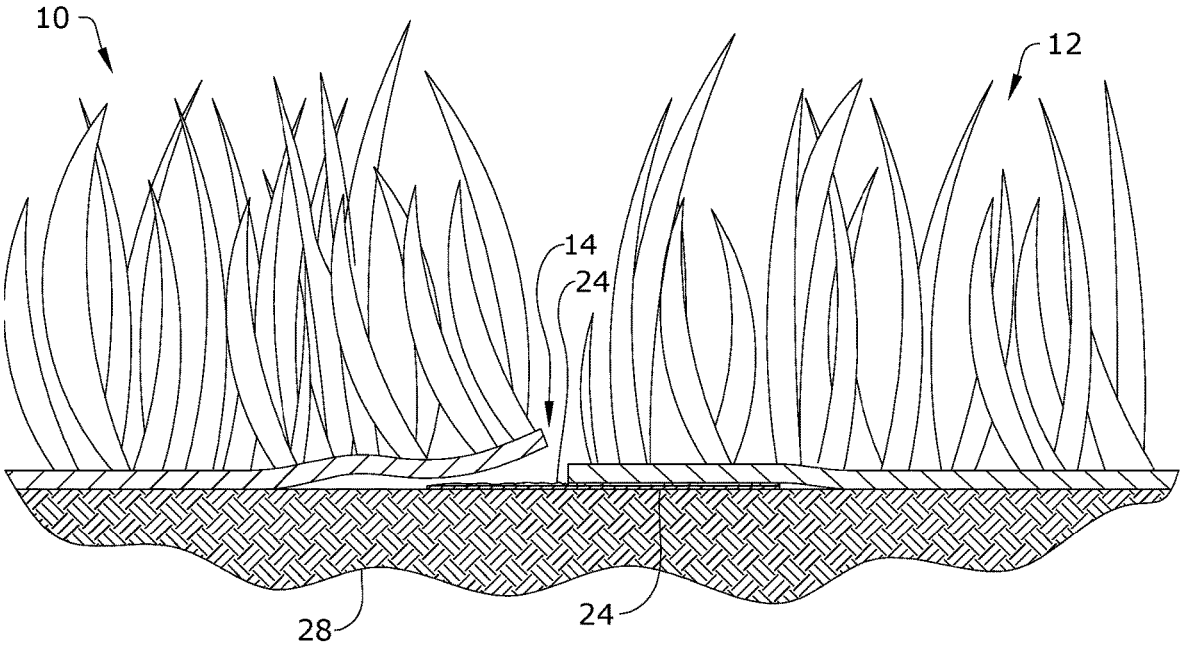
FIG. 1 depicts a front view of an artificial turf installation apparatus in the prior art.

FIG. 1 depicts an artificial turf installation apparatus in the prior art on ground 28, which comprises a pair of adjacent artificial turf members including first turf member 10, second turf member 12, and backing 24. Backing 24 is generally a fiber tape approximately 3 to 12 inches in width that extends along a seam of first and second turf members 10, 12. First and second turf members 10, 12 are disposed on backing 24 and arranged so corresponding sides of first and second turf members 10, 12 are aligned along seam line 14. In some instances, glue is disposed on backing 24 to help secure first and second turf members 10, 12 thereon.

The artificial turf installation apparatus in the prior art is problematic because glue disposed on backing 24 takes time to dry, thereby enabling first and second turf members 10, 12 to shift relative to each other prior to the time the glue cures. Further, the connection along seam line 14 weakens after years of expansion and contraction of the glue, thereby enabling first and second turf members 10, 12 to shift over time.

Figure 2:
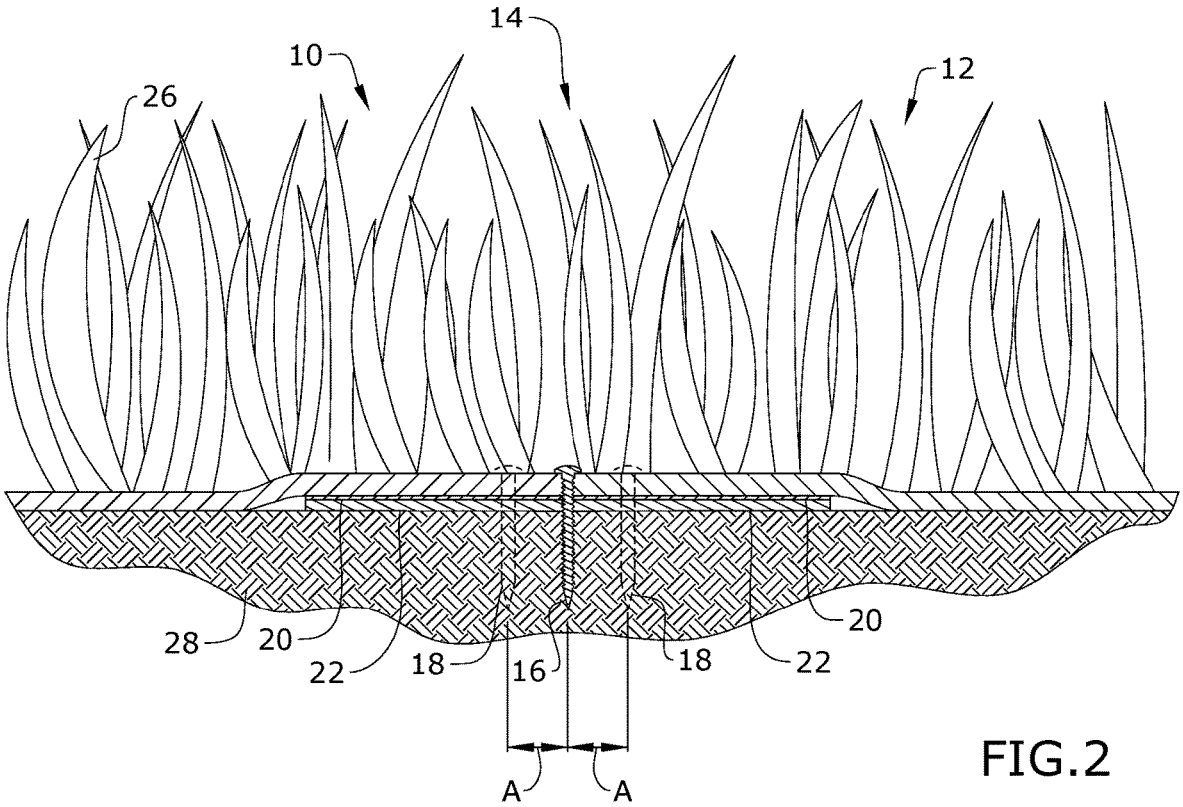
FIG. 2 depicts a section view of an artificial turf installation apparatus shown in use in certain embodiments of the invention.
Figure 3:
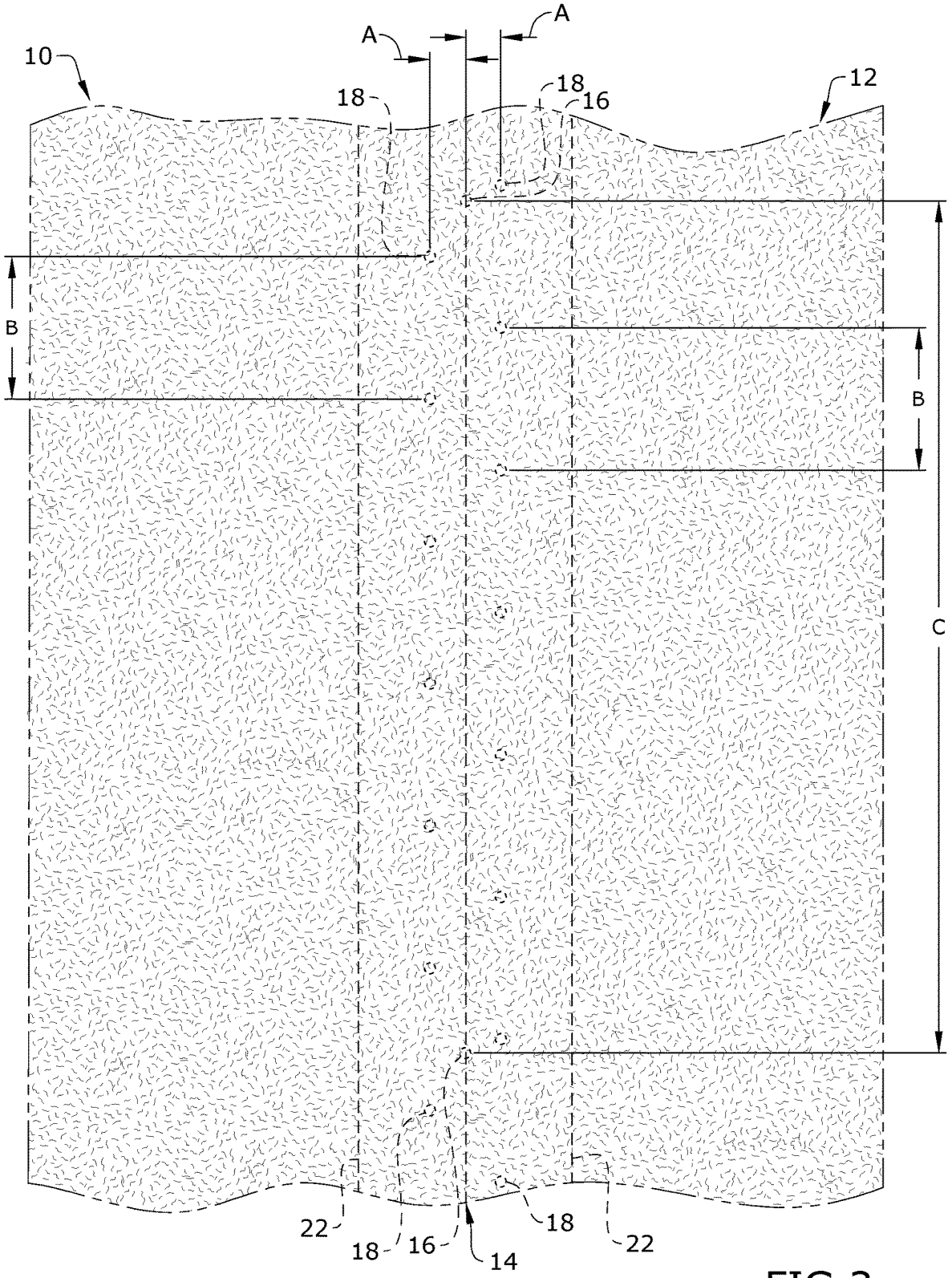
FIG. 3 depicts a top schematic view of an artificial turf installation apparatus shown in use in certain embodiments of the invention.

In certain embodiments of the invention, the artificial turf installation apparatus and method are configured to enhance the connection strength of secured adjacent artificial turf members and reduce the visibility of the seam line along corresponding edges of the secured turf members. As depicted in FIGS. 2-3, the artificial turf installation apparatus generally comprises joint strip 22, first turf member 10, second turf member 12, primary fasteners 16 and secondary fasteners 18.

Each turf member in first and second turf members 10, 12 is an artificial turf sheet commonly known in the field, which comprises a plurality of blades 26 of grass coupled to a plurality of parallel rows by stitching. The parallel set of stitch rows extend throughout the entire artificial turf sheet. The gap (gauge of the turf) between each adjacent pair of stitch rows in first and second turf members 10, 12 is preferably ⅜" wide. However, this gap may be ½" or an alternative distance. Each turf member in first and second turf members 10, 12 is generally available in a roll that unwinds to a flat sheet having a width of 12'-50' and length of 50'-100'. However, the size of each turf member is cut to the desired dimensions.

In one embodiment, joint strip 22 is a flexible strip of high tensile, non-corrosive material, such as aluminum alloy, plastic or fiberglass, which serves as a joining member to connect first and second turf members 10, 12 together. In certain embodiments, joint strip 22 comprises a thickness within the approximate range of 0.039"-0.20", width within the approximate range of 2"-6", and a length sufficiently long to extend beneath seam line 14 between adjacent side edges of first and second turf members 10, 12. In a preferred embodiment, joint strip 22 is a 5052 aluminum alloy strip with a thickness of 0.63" and width of 3".

Primary fasteners 16 and secondary fasteners 18 are used to secure first and second turf members 10, 12 to joint strip 22. In one embodiment, primary fasteners 16 and secondary fasteners 18 are ¼"-2" self-tapping or self-drilling screws. In one embodiment, each fastener in primary and secondary fasteners 16, 18 comprise a head-like modified truss head screw or large hex head with washer screw. It shall be appreciated that the size of primary and secondary fasteners 16, 18 used depends on the thickness of joint strip 22, but should be sufficiently sized to penetrate through primary and secondary turf members 10, 12, joint strip 22, and ground 28. Self-drilling screws are preferred when joint strip 22 is a material that is too difficult for a self-tapping screw to pierce through on its own. In one embodiment, glue 20 is disposed between joint strip 22 and first and second turf members 10, 12 to enhance securement of the components together.

In certain embodiments of the invention, one or more of the following exemplary steps are performed in the method to secure adjacent first and second turf members 10, 12 together. A user disposes joint strip 22 on ground 28. First turf member 10 is disposed on joint strip 22 so that the side edge of the turf member extends along the central longitudinal axis of joint strip 22. In this configuration, the plurality of stitch rows of first turf member 10 are generally parallel to the central longitudinal axis of joint strip 22. In one embodiment, the user uses a caulking gun to apply glue 20 between joint strip 22 and first turf member 10 to enhance the connection of the members together.

Primary fasteners 16 are inserted through the side edge of first turf member 10 along seam line 14, joint strip 22, and ground 28 as depicted in FIGS. 2-3. In one embodiment, primary fasteners 16 are spaced apart from each other by distance C, where C is preferably equal to approximately 1'. Secondary fasteners 18 are inserted through first turf member 10, joint strip 22, and ground 28 a distance A from seam line 14, where A is preferably equal to approximately ¼"-1¼".

In one embodiment, secondary fasteners 18 are arranged in a zig-zag pattern throughout first turf member 10 such that secondary fasteners 18 may be inserted through different gaps between parallel stitch rows in first turf member 10. In an alternative embodiment, secondary fasteners 18 are arranged along a generally straight line in the same gap between an adjacent pair of parallel stitch rows in first turf member 10. Secondary fasteners 18 are spaced apart from each other by distance B, where B is preferably equal to approximately 2"-8" if glue is disposed between first turf member 10 and joint strip 22. Distance B is preferably equal to approximately 1½"-5" if glue is not disposed between first turf member 10 and joint strip 22.

Second turf member 12 is secured to joint strip 22 in the same manner previously described for first turf member 10. Specifically, second turf member 12 is disposed on joint strip 22 so that the side edge of the turf member extends along the central longitudinal axis of joint strip 22. In this configuration, seam line 14 is aligned with the corresponding side edges of first and second turf members 10, 12. In addition, the parallel stitch rows of first turf member 10 are parallel to the parallel stitch rows of second turf member 12. In one embodiment, the user uses a caulking gun to apply glue 20 between joint strip 22 and second turf member 12 to enhance the connection of the members together.

Primary fasteners 16 are inserted through the side edge of second turf member 12 along seam line 14, joint strip 22, and ground 28 as depicted in FIGS. 2-3. In one embodiment, primary fasteners 16 are spaced apart from each other by distance C, where C is preferably equal to approximately 1'. Secondary fasteners 18 are inserted through second turf member 12, joint strip 22, and ground 28 a distance A from seam line 14, where A is preferably equal to approximately ¼"-1¼".

In one embodiment, secondary fasteners 18 are arranged in a zig-zag pattern throughout second turf member 12 such that secondary fasteners 18 may be inserted through different gaps between parallel stitch rows in second turf member 12. In an alternative embodiment, secondary fasteners 18 are arranged along a generally straight line in the same gap between an adjacent pair of parallel stitch rows in second turf member 12. Secondary fasteners 18 are spaced apart from each other by distance B, where B is preferably equal to approximately 2"-8" if glue is disposed between second turf member 12 and joint strip 22. Distance B is preferably equal to approximately 1½"-5" if glue is not disposed between second turf member 12 and joint strip 22.

Figure 4:
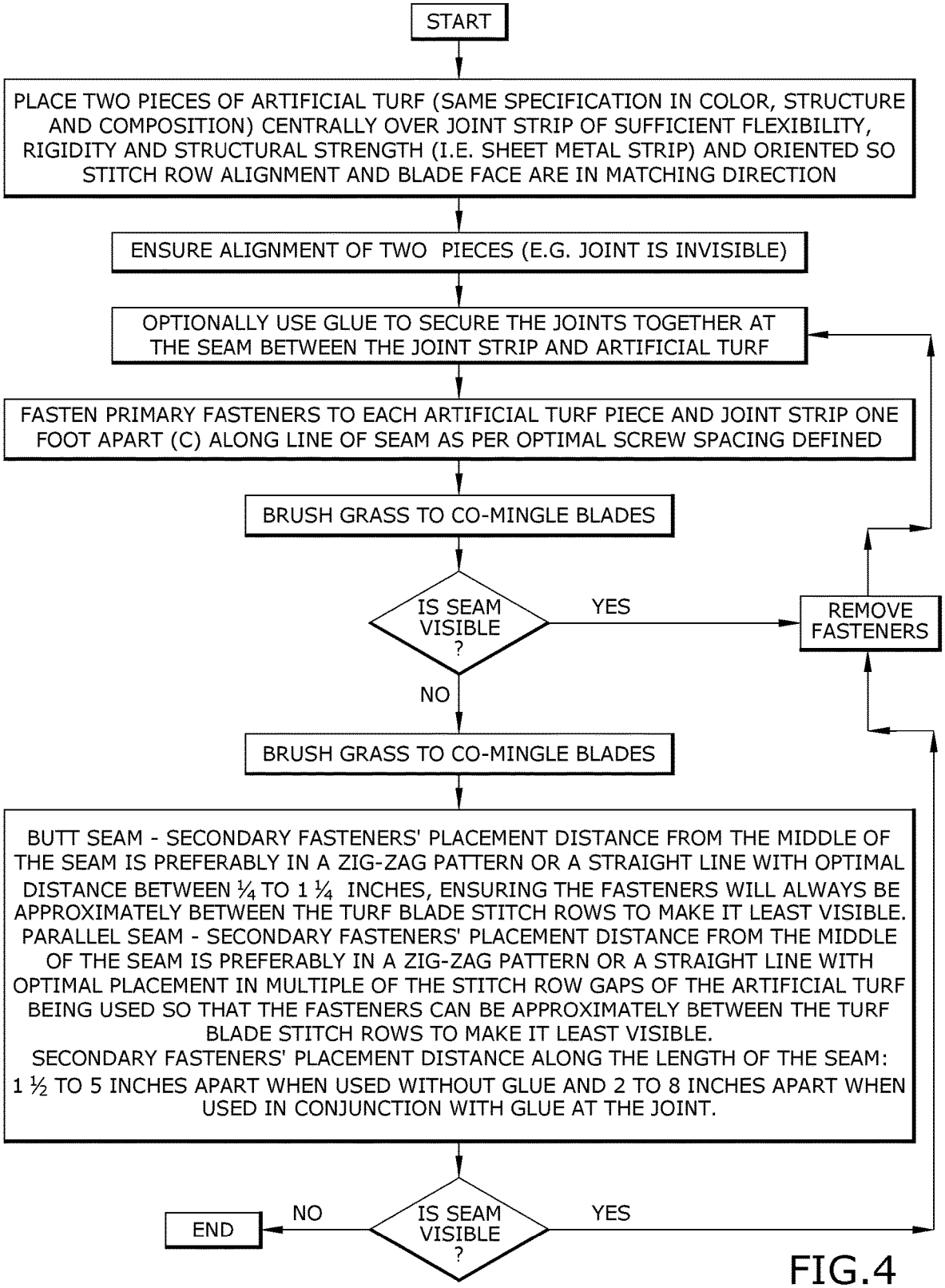
FIG. 4 depicts a flowchart of a method of securing artificial turf members to the ground in accordance with certain embodiments of the invention.

Blades 26 of grass in first and second turf members 10, 12 are comingled to cover seam line 14. If the alignment of first and second turf members 10, 12 is unacceptable and/or the joint along seam line 14 is visible, primary and secondary fasteners 16, 18 may be removed to permit a realignment of first and second turf members 10, 12 relative to each other. Once first and second turf members 10, 12 are in the correct position, primary and secondary fasteners 16, 18 are reinserted into the appropriate turf member(s). FIG. 4 illustrates a series of exemplary steps performed in certain embodiments of the method to secure first and second turf members 10, 12 together.

It is understood that primary and secondary fasteners 16, 18 are driven through first and second turf members 10, 12, joint strip 22, and ground 28 either manually or automatically by use of a tool such as a screwdriver. In all cases, primary and secondary fasteners 16, 18 are disposed through first and second turf members 10, 12 in any number of gaps between parallel stitch rows of the turf members. This prevents the primary and secondary fasteners 16, 18 from crimping or pressing down blades 26 of grass in first and second turf members 10, 12.

Figure 5:
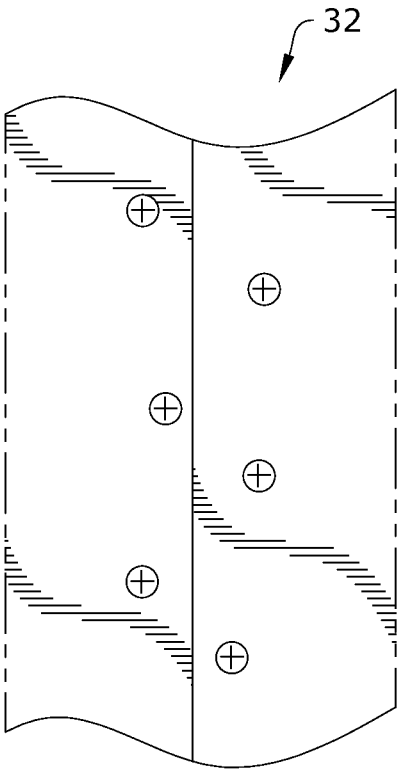
FIG. 5 depicts a top schematic view of a parallel seam in an artificial turf installation apparatus in certain embodiments of the invention.
Figure 6:
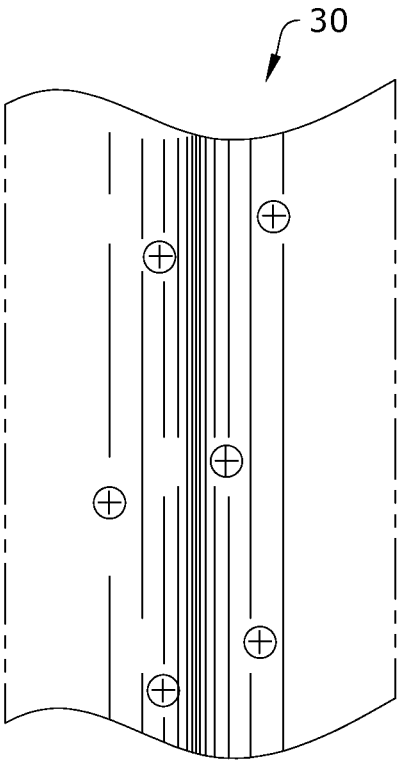
FIG. 6 depicts a top schematic view of a butt seam in an artificial turf installation apparatus in certain embodiments of the invention.

In certain embodiments of the invention, adjacent turf members may be aligned together and secured to joint strip 22 in two configurations. The first configuration is a parallel seam arrangement as discussed in previous embodiments. A parallel seam occurs when seam line 14 of first and second turf members 10, 12 is parallel to the stitch rows in first and second turf members 10, 12. FIG. 5 depicts an exemplary parallel seam assembly 32 illustrating the fasteners and adjacent turf members. The second configuration is a butt seam arrangement where seam line 14 of adjacent turf members is perpendicular to the stitch rows in the adjacent turf members. FIG. 6 depicts an exemplary butt seam assembly 30 illustrating the fasteners and adjacent turf members. In both parallel seam assembly 32 and butt seam assembly 30, primary and secondary fasteners 16, 18 are disposed through first and second turf members 10, 12 in one or more gaps between parallel stitch rows of the turf members.

It shall be appreciated that the components of the artificial turf installation apparatus described in several embodiments herein may comprise any alternative known materials in the field and be of any color, size and/or dimensions. It shall be appreciated that the components of the artificial turf installation apparatus described herein may be manufactured and assembled using any known techniques in the field.

Persons of ordinary skill in the art may appreciate that numerous design configurations may be possible to enjoy the functional benefits of the inventive systems and methods. Thus, given the wide variety of configurations and arrangements of embodiments of the present invention, the scope of the invention is reflected by the breadth of the claims below rather than narrowed by the embodiments described above.

What is claimed is:

1. A method to secure an adjacent pair of turf members to a ground surface with enhanced connection strength and reduce visibility of a seam line along corresponding edges of the secured adjacent turf members, each turf member in the pair of turf members comprising a side edge extending along the seam line and a plurality of blades of grass coupled to the turf member along a set of parallel stitch rows, the method comprising:

disposing a joint strip on the ground surface;

disposing a first turf member on a first portion of the joint strip;

inserting a first set of primary fasteners through the first turf member on the side edge along the seam line, joint strip, and the ground surface;

inserting a first set of secondary fasteners through the first turf member, joint strip and the ground surface in spacing between the stitch rows of the first turf member;

disposing a second turf member on a second portion of the joint strip to permit the side edge of the second turf member to align with the side edge of the first turf member along the seam line;

inserting a second set of primary fasteners through the second turf member on the side edge along the seam line, joint strip, and the ground surface; and inserting a second set of secondary fasteners through the second turf member, joint strip and the ground surface in spacing between stitch rows of the second turf member.

2. The method of claim 1, further comprising comingling the plurality of blades of grass of the first turf member and the plurality of blades of grass of the second turf member along the seam line.

3. The method of claim 2, further comprising positioning the primary fasteners in the first set of primary fasteners approximately 1 foot from each other and positioning the primary fasteners in the second set of primary fasteners approximately 1 foot from each other.

4. The method of claim 3, further comprising positioning the secondary fasteners in the first set in a zigzag pattern along the first turf member and positioning the secondary fasteners in the second set in a zigzag pattern along the second turf member.

5. The method claim 4, further comprising positioning each secondary fastener in the first set within the approximate range of ¼"-1¼" inches from the seam line of the first and second turf members and positioning each secondary fastener in the second set within the approximate range of ¼"-1¼" inches from the seam line of the first and second turf members.

6. The method of claim 5, further comprising positioning the secondary fasteners in the first set of secondary fasteners approximately 1½"-5" from each other and positioning the secondary fasteners in the second set of secondary fasteners approximately 1½"-5" from each other.

7. The method of claim 5, further comprising applying glue to the first and second turf members to secure the first and second turf members to the joint strip.

8. The method of claim 7, further comprising positioning the secondary fasteners in the first set of secondary fasteners approximately 2"-8" from each other and positioning the secondary fasteners in the second set of secondary fasteners approximately 2"-8" from each other.

9. The method of claim 8, wherein the joint strip is made from 5052 aluminum alloy with a thickness within an approximate range of 1-5 millimeters.

10. The method of claim 8, wherein the primary fasteners and secondary fasteners comprise self-tapping or self-drilling screws.

* * * * *